US012687106B2

(12) United States Patent
Penno et al.

(10) Patent No.: US 12,687,106 B2
(45) Date of Patent: Jul. 21, 2026

(54) DOWNHOLE FIBER OPTIC CONNECTOR WITH A SIDE POCKET AND KICK OVER ASSEMBLY IN A WELLBORE

(71) Applicant: Halliburton Energy Services, Inc., Houston, TX (US)

(72) Inventors: Andrew Penno, Singapore (SG); David Speed, Carrollton, TX (US); Tyson H. Eiman, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 195 days.

(21) Appl. No.: 18/348,091

(22) Filed: Jul. 6, 2023

(65) Prior Publication Data

US 2025/0012185 A1 Jan. 9, 2025

(51) Int. Cl.
*E21B 47/135* (2012.01)
*E21B 23/03* (2006.01)

(52) U.S. Cl.
CPC ..... *E21B 47/135* (2020.05); *E21B 23/03* (2013.01)

(58) Field of Classification Search
CPC ..... E21B 23/03; E21B 17/023; E21B 17/028
See application file for complete search history.

(56) References Cited

U.S. PATENT DOCUMENTS 2,828,698 A 4/1958 Bryan
2,942,671 A 6/1960 Schramm
2,948,341 A 8/1960 Fredd
3,312,283 A 4/1967 Yetman
3,799,259 A * 3/1974 Dinning ..... E21B 23/03 166/117.5
3,827,490 A * 8/1974 Moore, Jr. ..... E21B 23/03 166/117.5
3,874,445 A * 4/1975 Terral ..... E21B 23/03 166/117.5
4,480,687 A 11/1984 Terral
4,640,350 A * 2/1987 Akkerman ..... E21B 23/03 166/117.5
5,355,952 A 10/1994 Meynier
(Continued)

FOREIGN PATENT DOCUMENTS

WO 2022109157 5/2022
WO 2022192669 9/2022

OTHER PUBLICATIONS

"Decoding the Reservoir", https://www.halliburton.com/en/completions/well-completions/the-future-of-completions/decoding-the-reservoir, 2023, 4 pages.

(Continued)

*Primary Examiner* — Cathleen R Hutchins
(74) *Attorney, Agent, or Firm* — DeLizio, Peacock, Lewin & Guerra LLP

(57) ABSTRACT

Embodiments of a connection apparatus, system, and method for installing into a wellbore are disclosed. In one example, a connection apparatus comprises a first half wet mate connector coupled in a side pocket of a side pocket assembly of a completion string that is to be positioned downhole in a wellbore; a kick over assembly coupled onto a production string, the kick over assembly having an inner diameter; and a second half wet mate connector coupled to the kick over assembly to be positioned downhole in the wellbore.

20 Claims, 5 Drawing Sheets

(56) References Cited

U.S. PATENT DOCUMENTS

| | | | | |
|---|---|---|---|---|
| 5,455,573 | A * | 10/1995 | Delatorre | E21B 23/03 166/250.11 |
| 6,419,022 | B1 * | 7/2002 | Jernigan | E21B 43/14 166/336 |
| 6,873,267 | B1 * | 3/2005 | Tubel | E21B 43/12 166/250.15 |
| 7,063,143 | B2 * | 6/2006 | Tilton | E21B 34/16 166/242.6 |
| 7,165,892 | B2 | 1/2007 | Grigsby et al. | |
| 7,556,093 | B2 | 7/2009 | Grigsby et al. | |
| 7,640,993 | B2 * | 1/2010 | Head | E21B 23/02 166/385 |
| 7,900,698 | B2 | 3/2011 | Stoesz | |
| 8,746,354 | B2 | 6/2014 | Head | |
| 8,752,635 | B2 | 6/2014 | Wang et al. | |
| 9,322,252 | B2 * | 4/2016 | Head | E21B 33/0385 |
| 9,546,527 | B2 | 1/2017 | Head | |
| 2003/0085815 | A1 | 5/2003 | Tilton et al. | |
| 2006/0243450 | A1 | 11/2006 | Head | |
| 2006/0260818 | A1 * | 11/2006 | Meijer | E21B 17/023 166/380 |
| 2017/0260834 | A1 * | 9/2017 | Chacon | E21B 47/024 |
| 2022/0356803 | A1 | 11/2022 | Guelat et al. | |

OTHER PUBLICATIONS

"Digital Ecosystem", https://www.halliburton.com/en/completions/well-completions/the-future-of-completions/digital-ecosystem, 2023, 5 pages.

"Dive Deep Into the Advantages of Underwater Mate-Able Electrical Connectors", Ametek, Inc., https://www.hermeticseal.com/news/blog/2020/october/underwater-mate-able-electrical-connectors, Oct. 21, 2020, 7 pages.

"Empower Your Wells to Become Wellbore Data Superhighways", Halliburton, https://www.halliburton.com/en/completions/well-completions/the-future-of-completions/all-electric-completions, 2023, 5 pages.

"Halliburton 4.0", https://www.halliburton.com/en/halliburton-4-0, 2023, 13 pages.

"SEACON 3: Low Profile, Low Loss Optical Performance, Optical Wet-Mate Connector", TE Connectivity, https://www.te.com/usa-en/products/connectors/intersection/optical-wet-mate.html, 2019, 2 pages.

"The Future of Completions", https://www.halliburton.com/en/completions/well-completions/the-future-of-completions, 2023, 7 pages.

O'Hara, et al., "Building Data Superhighways", Oilfield Technology Issue 1, 2021, 3 pages.

"PCT Application No. PCT/US2023/069836 International Search Report and Written Opinion", Oct. 24, 2025, 10 pages.

* cited by examiner

DOWNHOLE FIBER OPTIC CONNECTOR WITH A SIDE POCKET AND KICK OVER ASSEMBLY IN A WELLBORE

BACKGROUND

There may be multiple stages of a wellbore during recovery of hydrocarbons therefrom. For a completion stage, there can be a lower stage and an upper stage. For completion of the lower stage, a lower completion assembly may be positioned downhole in the wellbore on a running string. After completion of the lower stage, an upper stage can be completed. This may include deployment of an upper stage completion assembly that is also coupled or engaged with the lower completion assembly.

Part of this coupling or engaging of the upper completion assembly with the lower completion assembly may include coupling of fiber optics to be used for downhole sensing and/or communication. For example, a fiber optic cable may be positioned in the annulus for either an open hole or cased hole configuration. This connecting of a fiber optic cable between the lower and upper completion assemblies may require a wet mate connection to enable connection in a wet environment downhole.

BRIEF DESCRIPTION OF THE DRAWINGS

Embodiments of the disclosure may be better understood by referencing the accompanying drawings.

DESCRIPTION

Figure 1:
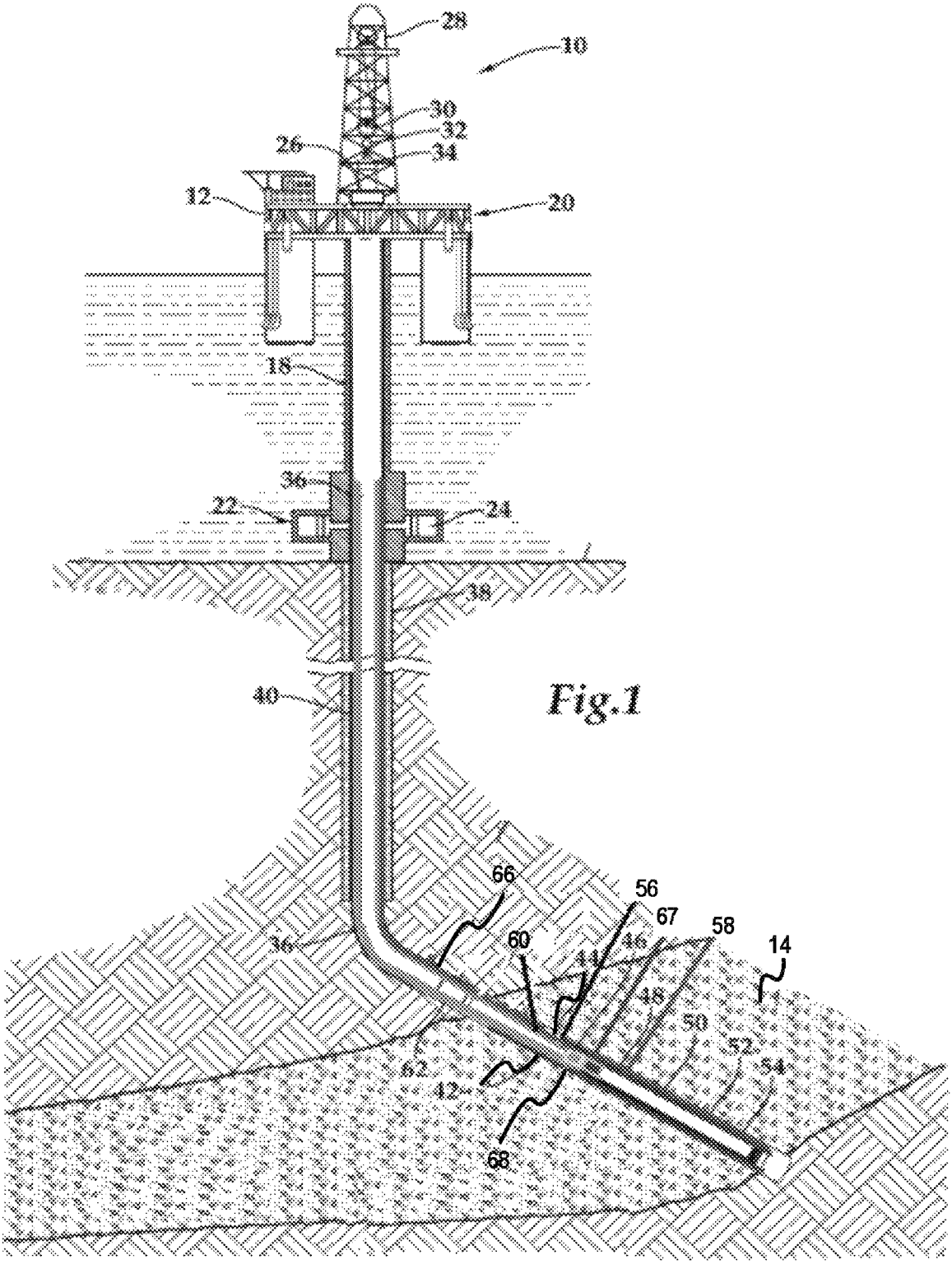
FIG. 1 is a schematic view of an oil or gas platform including one example of a downhole connection assembly, the downhole connection assembly including a side pocket assembly and kick over assembly in a wellbore, according to some embodiments.

The description that follows includes example systems, methods, techniques, and program flows that embody aspects of the disclosure. However, it is understood that this disclosure may be practiced without these specific details. In some instances, well-known instruction instances, protocols, structures, and techniques have not been shown in detail in order not to obfuscate the description.

Embodiments include connecting a downhole fiber optic line with capability to pass restrictions and then extend radially outward to maximize the inner diameter (ID) through the fiber optic connection for production flow area and passing tools through the fiber optic connection. Examples of a downhole connector utilizes a side pocket assembly run on a completion string and having a kick over assembly run on the production string to connect two halves of a fiber optic connector, such as a wet mate connector, in the wellbore. The side pocket assembly is run into the well with a first half of the wet mate connector on the completion string below the gravel pack kit. The kick over assembly with a second half of the wet mate connector is run in the well on the production string in a retracted position allowing for passage of the second half of the wet mate through restrictions in the wellbore, such as packers, frac sleeves, indicator couplings, fluid loss devices and/or other gravel pack completion equipment.

Once reaching the completion string equipment, the second half of the wet mate connector is deployed into the side pocket assembly for connection to the first half of the wet mate connector. By running the wet mate connector in a retracted position and then deploying the connector radially outward once it is downhole and then connecting allows for larger ID's above and below the wet mate connection during downhole operations, such as, e.g., gravel pack operations, and increased IDs for production flow through the connector following connection.

Examples of downhole fiber optic connectors, systems and methods included herein provide a larger ID on the production string and completion string as compared to connector assemblies and methods previously available. Examples included also allow for use of existing gravel pack lower completion equipment above the indicator coupling as required some downhole completion systems, which may allow for disconnecting and reconnecting of downhole components. Example embodiments incorporate a first half of a connector, such as a first half wet mate connector in the completion string side pocket assembly and a second half of a connector, such as the second half wet mate connector attached with on the Kick Over Assembly.

Downhole fiber optic connectors and methods disclosed herein allow for passage through restrictions such as packer bores and other gravel pack/frac pack equipment, and then deploying outward to connect with the first half of the wet mate connection run on the completion string. The kick out deployment achieves smaller running outer diameters (ODs) for passage of restrictions and provides larger inner diameters (IDs) for production flow area and passing tools through the wet mate connector.

Example Embodiments

FIG. 1 is a schematic view of an oil or gas platform 10 including an apparatus for connecting downhole connectors, such as fiber optic wet mate connectors, deployed from the platform 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26, a derrick 28, a travel block 30, a hook 32 and a swivel 34 for raising and lowering pipe strings, such as a substantially tubular, axially extending production tubing string 36.

A wellbore 38 extends through the various earth strata including formation 14. An upper portion of the wellbore 38 includes casing 40 that is cemented within the wellbore 38. Disposed in an open hole portion of the wellbore 38 is a lower completion 42. Lower completion 42 includes various tools such as packer 44, a seal bore assembly 46, and sand control screen assemblies 48, 50, 52, 54. In the illustrated embodiment, completion 42 also includes an orientation and alignment subassembly 56 that houses a downhole wet mate connector.

Extending downhole from orientation and alignment subassembly 56 is a conduit/energy transfer line 58 that passes through packer 44 and is operably associated with sand control screen assemblies 48, 50, 52, 54. Conduit 58 may be a spoolable metal conduit, such as a stainless steel conduit that may be attached to the exterior of pipe strings as they are deployed in the well. In the illustrated embodiment, conduit 58 is wrapped around sand control screen assemblies 48, 50, 52, 54. One or more communication media such as optical fibers, electrical conducts, hydraulic fluid or the like may be disposed within conduit 58. In certain embodiments, the communication media may operate as energy conductors that are operable to transmit power and/or data between downhole components such as downhole sensors (not pictured) and the surface. In other embodiments, the communication media may operate as downhole sensors.

For example, when optical fibers are used as the communication media, the optical fibers may be used to obtain distributed measurements representing a parameter along the entire length of the fiber such as distributed temperature sensing. In this embodiment, a pulse of laser light from the surface is sent along the fiber and portions of the light are backscattered to the surface due to the optical properties of the fiber. The slightly shifted frequency of the backscattered light provides information that is used to determine the temperature at the point in the fiber where the backscatter originated. In addition, as the speed of light is constant, the distance from the surface to the point where the backscatter originated can also be determined. In this manner, continuous monitoring of the backscattered light will provide temperature profile information for the entire length of the fiber.

Disposed in wellbore 38 at the lower end of production tubing string 36 may be a variety of tools including seal assembly 60 and anchor assembly 62. A receptacle subsystem 67 may be coupled in the wellbore, and in this example, may be coupled downhole of the anchor assembly. The receptacle subsystem 67 may include a housing with a side pocket assembly in an inner surface thereof. A first half wet mate connector may be positioned within the side pocket assembly of the receptacle subsystem 67.

A stinger subsystem 68 may be inserted downhole into the wellbore and coupled with the production string 36. A second half wet mate connector may be coupled with a kick over assembly of the stinger subsystem 68. The kick over assembly has an inner diameter (ID) that is larger than previously available downhole connection assemblies, which provides a flow path within the annulus for fluids to pass from the formation to the surface, such as production and other fluids, or fluids may flow from the surface to the formation, such as for injection such that the kick over assembly may remain downhole. The kick over assembly of the stinger subsystem 68 may include a plurality of mandrels rotatably coupled together, wherein the kick over assembly may rotate and move radially outward to connect the second half wet mate connector with the first half wet mate connector. Extending uphole of the stinger subsystem 68 may be a conduit/energy transfer line 66 that extends to the surface in the annulus between production tubing string 36 and wellbore 38 and may be coupled to production tubing string 36 to prevent damage to conduit 66 during installation. Similar to conduit 58, conduit 66 may have one or more communication media, such as optical fibers, electrical conductors, hydraulic fluid or the like disposed therein.

Conduit 58 and conduit 66 may have the same type of communication media disposed therein such that energy may be transmitted therebetween following the connection process. Prior to producing fluids, such as hydrocarbon fluids from formation 14, production tubing string 36 and completion 42 are connected together. When properly connected to each other, a sealed communication path is created between seal assembly 60 and seal bore assembly 46 which establishes a sealed internal flow passage from completion 42 to production tubing string 36, thereby providing a fluid conduit to the surface for production fluids. In addition, as discussed in greater detail below, the present invention enables the communication media associated with conduit 66 to be operatively connected to the communication media associated with conduit 58, thereby enabling communication therebetween and, in the case of optical fiber communication media, enabling distributed temperature information to be obtained along completion 42 during the subsequent production operations.

The embodiment shown and described herein is a solution with a gravel pack completion kit. However, the connection system and method may be used with other completion solutions, such as, but not exclusively, frac pack kits, stand alone screens, single trip systems, liner conveyed systems and others.

Even though FIG. 1 depicts a slanted wellbore, it should be understood by those skilled in the art that the apparatus for connecting downhole connectors according to the present invention is equally well suited for use in wellbore having other orientations including vertical wellbores, horizontal wellbores, multilateral wellbores or the like. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Also, even though FIG. 1 depicts an offshore operation, it should be understood by those skilled in the art that the apparatus for connecting downhole connectors according to the present invention is equally well suited for use in onshore operations. Further, even though FIG. 1 depicts an open hole completion, it should be understood by those skilled in the art that the apparatus for connecting of downhole connectors according to the present invention is equally well suited for use in cased hole completions.

Figure 2A:
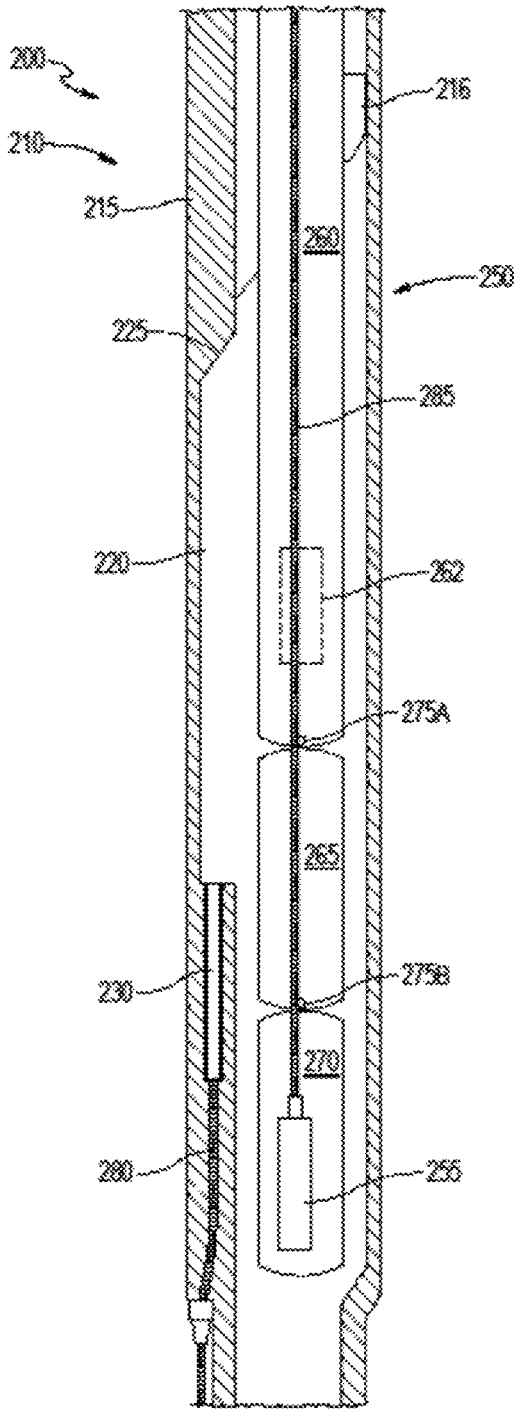
FIG. 2A is a side view of one example of a downhole connection assembly shown in a run in hole (first) position, according to some embodiments.
Figure 2B:
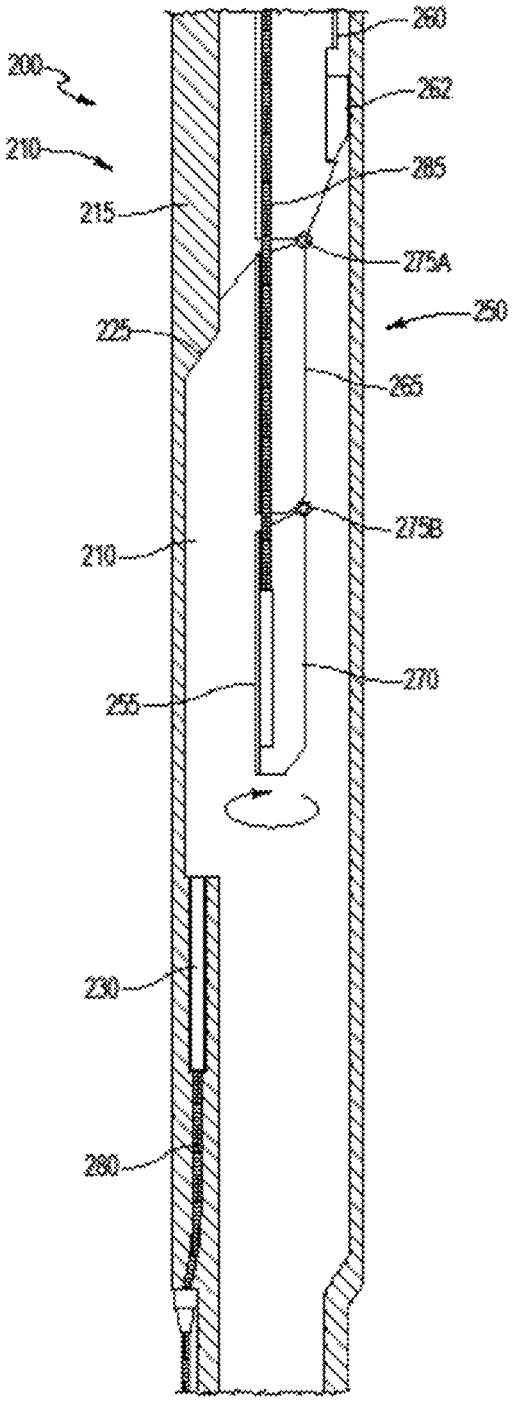
FIG. 2B is a side view of the downhole connection assembly in a second position, according to some embodiments.
Figure 2C:
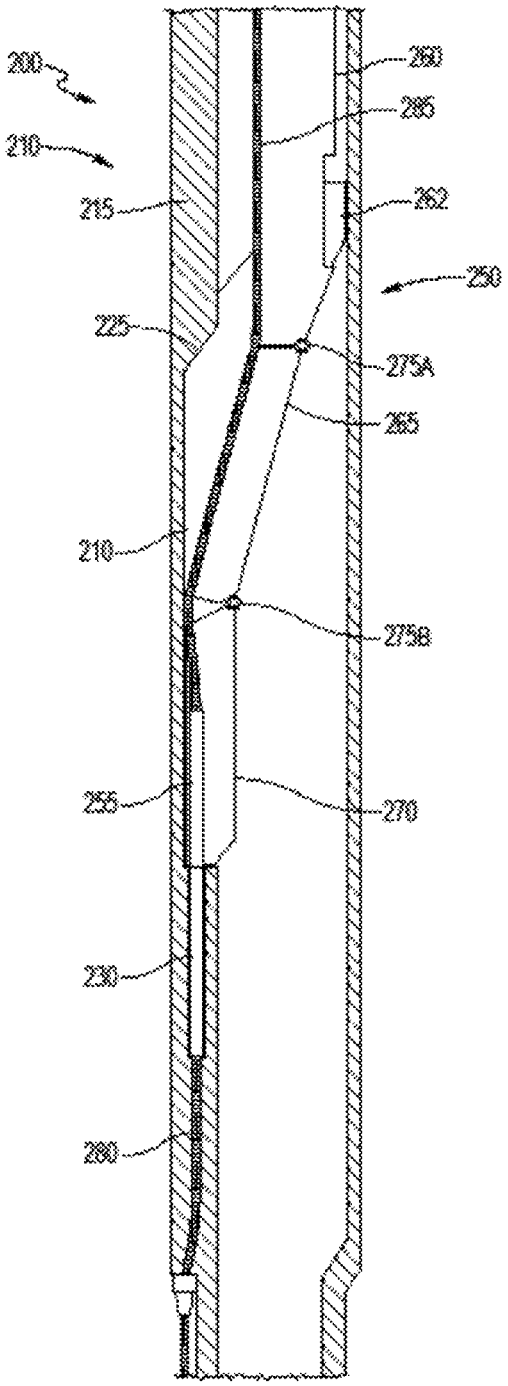
FIG. 2C is a side view of the downhole connection assembly in a third position, according to some embodiments.

FIG. 2A-2C illustrate one example of a fiber optic wet mate connection 200 which is comprised of two halves that are joined during well operations in a wellbore. Referring to FIG. 2A, a first subsystem, such as receptacle subsystem 67 of FIG. 1 may be positioned in the wellbore by a completion or production string, such as production string 36. The first subsystem includes a side pocket assembly 210. The side pocket assembly 210 may include a housing 215 having a side pocket 220 with an orienting profile 225 at an uphole end of the side pocket 220. Before deploying the first subsystem into the wellbore, a first half wet mate connector 230 is placed into and mated into the side pocket 220. In this embodiment, the side pocket assembly 210 is run in the well with drill pipe and service tool, but other means of conveyance such as coil tubing, liner, and/or tubing etc. may be used. Following conveyance of the completion string in the well, completion operations will be conducted which can include setting packers, gravel packing, formation treatments and/or other various activities. Following these activities, the drill pipe and service tool are tripped out of the well.

FIG. 2A depicts the run-in position for a kick over assembly 250, which may comprise a portion of a second subsystem, such as production/stinger subsystem 68 shown in FIG. 1. The kick over assembly 250 has a second half wet mate connector 255 coupled thereto proximate a downhole end of the kick over assembly 250. The kick over assembly may include a plurality of mandrels or subs, such as an orienting mandrel 260 at an uphole end, a kick over mandrel 265 coupled with the orienting mandrel 260, and a stinger sub 270 coupled downhole of the kick over mandrel 265. The plurality of mandrels may be coupled together via knuckle joints 275A and 275B. Following removal of the service tool and drill pipe, the second subsystem 240 is run into the wellbore on tubing and/or other conveyance method. The kick over assembly 250 has a through-inner diameter (ID) which provides a flow path for fluids to pass from the formation to the surface, such as production and other fluids, or fluids may flow from the surface to the formation, such as for injection. In a run-in position, the second half wet mate connector 255 is in a retracted position coupled proximate a downhole end of the stinger sub 270. This allows for the second half wet mate connector 255 to be transferred through the wellbore and completion string equipment items and passage through restrictions which can include packers, gravel pack sleeves, indicator couplings, fluid loss devices and/or other items in the wellbore.

Once reaching the first subsystem and first half wet mate connector 230, an orienting key 262 on the orienting mandrel 260 of the kick over assembly 250 passes through the orienting profile 225 of the side pocket assembly, whereby the orienting key 262 will retract and pass through. Following passage, the kick over assembly 250 is pulled back upward/uphole through the orienting profile 225 as shown in FIG. 2B. During the uphole/upward movement the orienting key 262 engages the orienting profile 225 which rotates the kick over assembly 250 to align the second half wet mate connector 255 with the first half wet mate connector 230.

As shown in FIG. 2C, the uphole movement engages a deployment shoulder with the orienting key 262 moving in downward/downhole motion relative to the orienting mandrel 260, which imparts a force on the knuckle joints 275A and 275B of the kick over assembly 250 which extends the second half wet mate connector 255 and stinger sub 270 radially outward into the side pocket 220. This process may be reversed with upward/uphole movement which will disconnect the second half wet mate connector from the first half wet mate connector and pull the kick over mandrel of the kick over assembly back to the inner diameter of the wellbore for retrieval or additional connection attempts if needed.

Once connected, a first fiber optic line 280 positioned downhole and connected with the first half wet mate connector 230 is operably coupled with a second fiber optic line 285 coupled with the second half wet mate connector 255 and run uphole to the surface of the wellbore. As such, the first and second half wet mate connectors 230 and 255 may be fiber optic connectors. Although the examples shown and described herein are shown connecting a single fiber optic line, this solution can include two, three or more fiber optic or other types of down hole wet mates.

In this example, the completion string and side pocket assembly 210 with the first half wet mate connector 230 are run in hole on a service tool and drill pipe. However, in other embodiments, the completion string and side pocket assembly 210 may be run in hole with the completion string on a liner, coil tubing, and/or tubing etc. Also described in this example is the production string and kick over assembly 250 with the second half wet mate connector 255 run in hole on tubing, but in other embodiments, the production string can be run in the wellbore with coil tubing, drill pipe, and/or other conveyance methods that provide a means for the fiber optic line and/or energy transfer line to be connected to surface along with a flow path for produced/injected fluids to pass to and from the formation to the surface and from the surface to the formation.

Alternatives examples may also include a latching locking assembly and/or soft connect tool that may be used with the side pocket assembly 210 and kick over assembly 250. A latching locking assembly can be run and coupled above the kick over mandrel 265 to lock the kick over mandrel 265 in place following connection of the first and second wet mate connectors 230 and 255. A soft connect tool may be used to control the connection speed of the kick over assembly 250 for a controlled kick out and connection.

Example Operations

Figure 3:
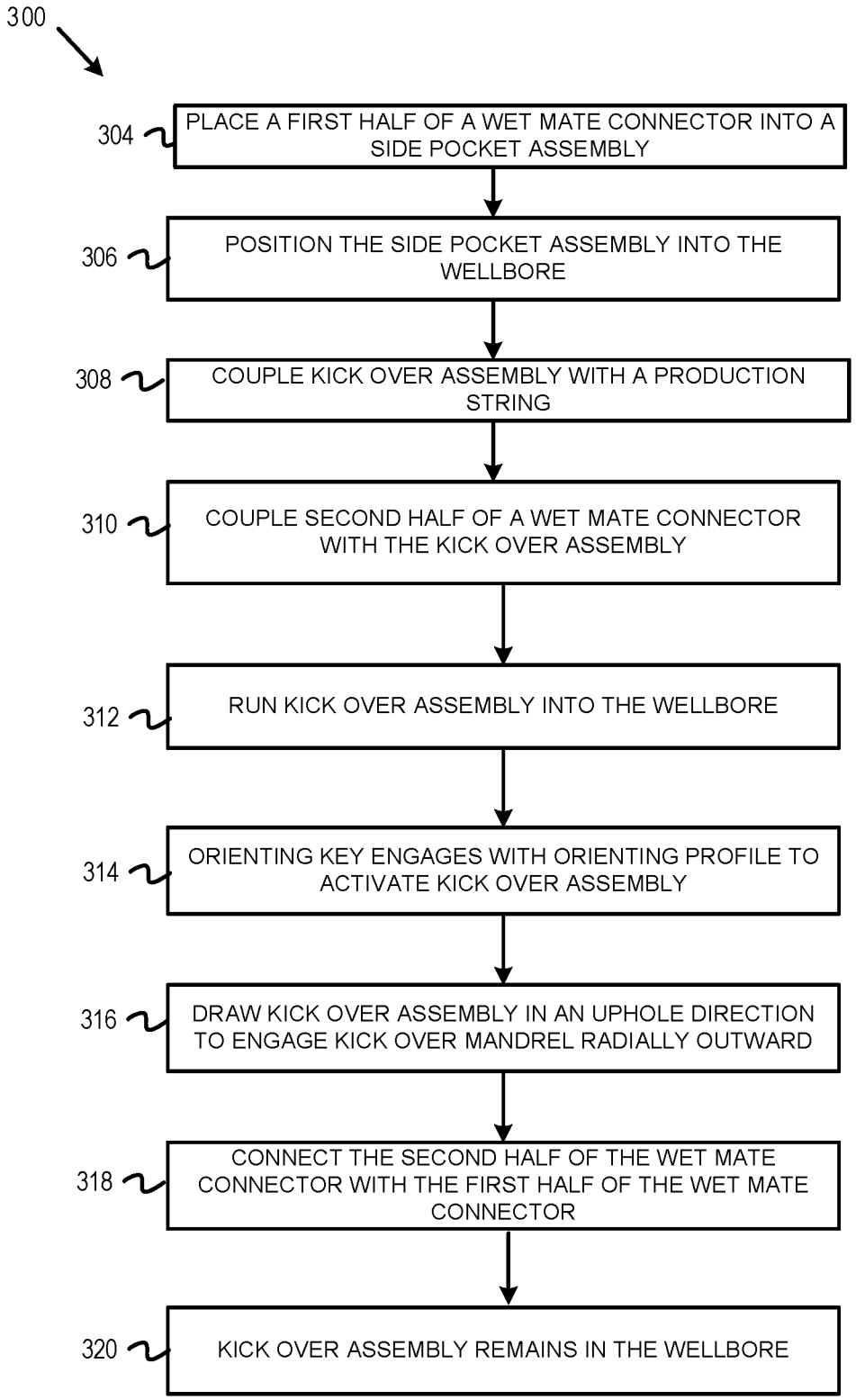
FIG. 3 is a method of making a downhole wet mate connection, according to some embodiments.

FIG. 3 is a flowchart illustrating one example of a method 300 for making a wet mate connection downhole in wellbore. The method begins at a block 304, where a first half of a wet mate connector is placed into a side pocket assembly of a first subsystem to be positioned in a wellbore.

At a block 306, the first subsystem with the side pocket assembly is placed into the wellbore. In some examples, such as in wellbore system 100, the first subsystem may be coupled downhole of a lower completion system and may be run in hole with the completion system.

At a block 308, a second subsystem having a kick over assembly is coupled with a production string to be placed downhole in the wellbore. The kick over assembly has an inner diameter to enable at least fluid flow through the kick over assembly while installed in the wellbore. In some examples, the kick over assembly may include a least an orienting mandrel at an uphole end, a kick over mandrel, and a stinger sub at a downhole end.

At a block 310, a second half of a wet mate connector is coupled with the kick over assembly, in some embodiments proximate a downhole end of the stinger sub. Note that in some implementations, the second half of the wet mate connector may be coupled with the kick over assembly prior to coupling with the production string.

At a block 312, the kick over assembly is run into the wellbore. At a block 314, the orienting key of the kick over assembly engages with the orienting profile of the side pocket assembly, activating the kick over assembly and rotating the kick over assembly to align with the first half wet mate. At a block 316, the production string is drawn in an uphole direction. As the production string is drawn in an uphole direction, the kick over assembly engages over and into the side pocket assembly.

At a block 318, the second half of the wet mate connector couples with the first half of the wet mate connector to complete the wet mate connection. In some examples, the first half of the wet mate connector and the second half of the wet mate connector may be coupled with upper and lower fiber optic lines, and the completing the wet mate connection operatively connects the fiber optic lines to facilitate a wet mate fiber optic connection.

At a block 320, the kick over assembly may remain in the wellbore. Because the kick over assembly has an inner diameter, fluid may flow freely uphole through the kick over assembly. In addition, if an adjustment needs to be made to the wet mate connection, the kick over assembly may be reengaged to adjust the connection of the second half wet mate connector with the first half wet mate connector. For example, the disconnecting the second half wet mate connector may be disconnected from the first half connector and repositioned for a better connection, such as, e.g., a faster connection speed or a signal with more clarity.

While embodiments described herein relate to connecting a fiber optic wet mate connector, the disclosed solution may also be used to connect other down hole wet mates in the wellbore such as electric, hydraulic, electro-hydraulic, electro-fiber, other suitable wet mates, or any combination thereof.

While the aspects of the disclosure are described with reference to various implementations and exploitations, it will be understood that these aspects are illustrative and that the scope of the claims is not limited to them. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

The flowcharts are provided to aid in understanding the illustrations and are not to be used to limit the scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

Example Embodiments

Aspects disclosed herein include:

Aspect A: A connection apparatus, comprising: a first half wet mate connector coupled in a side pocket of a side pocket assembly of a completion string that is to be positioned downhole in a wellbore; a kick over assembly coupled onto a production string, the kick over assembly having an inner diameter; and a second half wet mate connector coupled to the kick over assembly to be positioned downhole in the wellbore.

Aspect B: A connection system, comprising: a first subsystem positioned downhole in a wellbore, the first subsystem including a side pocket assembly; a production string to be run downhole into the wellbore; and a connection apparatus, including: a first half wet mate connector coupled in a side pocket of the side pocket assembly; a kick over assembly coupled onto the production string, the kick over assembly having an inner diameter; and a second half wet mate connector coupled to the kick over assembly to be positioned downhole in the wellbore.

Aspect C: A method of making a wet mate connection downhole in a wellbore, the method comprising: placing a first half wet mate connector into a side pocket assembly of a first subsystem to be positioned downhole in a wellbore; positioning the first subsystem into the wellbore; coupling a second subsystem with a production string to be placed downhole in the wellbore, wherein the second subsystem includes a kick over assembly having inner diameter; coupling a second half wet mate connector with the kick over assembly; positioning the second subsystem into the wellbore; engaging the kick over assembly with the first subsystem; and connecting the second half wet mate connector with the first half wet mate connector.

Aspects A, B, and C may have one or more of the following additional elements in combination:

Element 1: wherein the first half wet mate connector and second half wet mate connector facilitate a fiber optic wet mate connection; Element 2: wherein the kick over assembly has a plurality of mandrels rotatably coupled together; Element 3: wherein the plurality of mandrels are rotatably coupled together by knuckle joints; Element 4: wherein the kick over assembly includes an orienting mandrel coupled with the production string; Element 5: wherein the orienting mandrel includes an orienting key on an inner surface of the orienting mandrel, the orienting key configured to engage with an orienting profile on an inner surface proximate an uphole portion of the side pocket assembly; Element 6: wherein the kick over assembly includes a kick over mandrel coupled with the orienting mandrel; Element 7: wherein the kick over assembly includes a stinger sub coupled with the kick over mandrel; Element 8: wherein the stinger sub rotates and moves radially outward toward the side pocket to couple the second half wet mate connector with the first half wet mate connector; Element 9: wherein the first subsystem further includes a housing and an orienting profile in a downhole end of the housing, and wherein the side pocket assembly is positioned downhole of the orienting profile; Element 11: wherein the orienting mandrel includes an orienting key on an inner surface of the orienting mandrel, the orienting key configured to engage with an orienting profile of a downhole end of a housing of the first subsystem; Element 12: wherein connecting the second half wet mate connector with the first half wet mate connector operatively connects a lower fiber optic line coupled with the first half wet mate connector with an upper fiber optic line coupled with the second half wet mate connector that connects with a surface of the wellbore; Element 13: wherein engaging the kick over assembly with the first subsystem includes an orienting key on an orienting mandrel of the kick over assembly engaging an orienting profile at an uphole end of the side pocket assembly; Element 14: wherein connecting the second half wet mate connector with the first half wet mate connector includes rotating a stinger sub of the kick over assembly radially outward; and Element 15: further comprising disconnecting the second half wet mate connector from the first half wet mate connector and repositioning the second half wet mate connector for a better connection.

The invention claimed is:

1. A connection apparatus, comprising:

a first half wet mate connector coupled in a side pocket of a side pocket assembly within a completion string that is to be positioned downhole in a wellbore;

a kick over assembly comprising a kick over mandrel and a stinger sub coupled onto a production string, the kick over assembly having an inner diameter to permit fluid flow through the kick over assembly when the kick over assembly is installed within the wellbore, wherein the kick over assembly includes a retracting orienting key configured to pass through and to engage an orienting profile proximate an uphole end of the side pocket assembly; and a second half wet mate connector coupled to the kick over assembly to be positioned downhole in the wellbore, wherein the second half wet mate connector moves radially outward with the stinger sub toward and into the side pocket as the orienting key engages the orienting profile to align the second half wet mate connector with the first half wet mate connector while the kick over mandrel pivots radially outward and upward during upward movement of the kick over assembly.

2. The apparatus of claim 1, wherein the first half wet mate connector and second half wet mate connector facilitate a fiber optic wet mate connection.

3. The apparatus according to claim 1, wherein the kick over assembly has a plurality of mandrels rotatably coupled together.

4. The apparatus according to claim 3, wherein the plurality of mandrels are rotatably coupled together by knuckle joints.

5. The apparatus according to claim 1, wherein the kick over assembly includes an orienting mandrel coupled with the production string.

6. The apparatus according to claim 5, wherein the orienting key is positioned on the orienting mandrel and is configured to retract to pass through the orienting profile as the kick over assembly is run in hole and thereafter engage the orienting profile during uphole movement of the kick over assembly.

7. The apparatus according to claim 6, wherein the kick over assembly includes the kick over mandrel coupled with the orienting mandrel.

8. The apparatus according to claim 7, wherein the kick over assembly includes the stinger sub coupled with the kick over mandrel.

9. The apparatus according to claim 8, wherein the stinger sub rotates and moves radially outward toward the side pocket as the orienting key engages the orienting profile to couple the second half wet mate connector with the first half wet mate connector.

10. A connection system, comprising:

a first subsystem to be positioned downhole in a wellbore, the first subsystem including a side pocket assembly within the first subsystem, the side pocket assembly including an orienting profile proximate an uphole end of the side pocket assembly;

a production string to be run downhole into the wellbore; and a connection apparatus to be placed into the wellbore, including:

a first half wet mate connector coupled in a side pocket of the side pocket assembly;

a kick over assembly comprising a kick over mandrel and a stinger sub coupled onto the production string, the kick over assembly having an inner diameter to permit fluid flow through the kick over assembly when the kick over assembly is installed within the wellbore, wherein the kick over assembly includes a retracting orienting key configured to pass through and to engage the orienting profile of the side pocket assembly; and a second half wet mate connector coupled to the kick over assembly to be positioned downhole in the wellbore, wherein the second half wet mate connector moves radially outward with the stinger sub toward and into the side pocket as the orienting key engages the orienting profile to align the second half wet mate connector with the first half wet mate connector while the kick over mandrel pivots radially outward and upward during upward movement of the kick over assembly.

11. The system according to claim 10, wherein the first subsystem further includes a housing and an orienting profile in a downhole end of the housing, and wherein the side pocket assembly is positioned downhole of the orienting profile.

12. The system according to claim 10, wherein the first half wet mate connector and second half wet mate connector facilitate a fiber optic wet mate connection.

13. The system according to claim 10, wherein the kick over assembly has a plurality of mandrels rotatably coupled together, wherein the plurality of mandrels includes an orienting mandrel coupled with the production string, wherein the orienting key is positioned on the orienting mandrel and is configured to retract to pass through the orienting profile as the kick over assembly is run in hole and thereafter engage the orienting profile during uphole movement of the kick over assembly.

14. The system according to claim 13, wherein the plurality of mandrels includes the kick over mandrel coupled with the orienting mandrel.

15. The system according to claim 14, wherein stinger sub is coupled with the kick over mandrel, wherein the stinger sub rotates and moves radially outward toward the side pocket assembly to couple the second half wet mate connector with the first half wet mate connector.

16. A method of making a wet mate connection downhole in a wellbore, the method comprising:

placing a first half wet mate connector into a side pocket assembly within a first subsystem to be positioned downhole in the wellbore;

positioning the first subsystem into the wellbore;

coupling a second subsystem with a production string to be placed downhole in the wellbore, wherein the second subsystem includes a kick over assembly comprising a kick over mandrel and a stinger sub, the kick over assembly having an inner diameter to permit fluid flow through the kick over assembly when the kick over assembly is installed within the wellbore, wherein the kick over assembly includes a retracting orienting key configured to pass through and to engage an orienting profile proximate an uphole end of the side pocket assembly;

coupling a second half wet mate connector with the kick over assembly;

positioning the second subsystem into the wellbore;

engaging the kick over assembly with the first subsystem; and connecting the second half wet mate connector with the first half wet mate connector, wherein the second half wet mate connector moves radially outward with the stinger sub toward and into the side pocket as the orienting key engages the orienting profile to align the second half wet mate connector with the first half wet mate connector while the kick over mandrel pivots radially outward and upward during upward movement of the kick over assembly.

17. The method according to claim 16, wherein connecting the second half wet mate connector with the first half wet mate connector operatively connects a lower fiber optic line coupled with the first half wet mate connector with an upper fiber optic line coupled with the second half wet mate connector that connects with a surface of the wellbore.

18. The method according to claim 16, wherein the orienting key is positioned on an orienting mandrel of the kick over assembly and is configured to retract to pass through the orienting profile as the kick over assembly is run in hole and thereafter engage the orienting profile during uphole movement of the kick over assembly.

19. The method according to claim 18, wherein connecting the second half wet mate connector with the first half wet mate connector includes rotating the stinger sub of the kick over assembly with the orienting mandrel.

20. The method according to claim 16, further comprising disconnecting the second half wet mate connector from the first half wet mate connector with another uphole movement of the kick over assembly.

* * * * *